US007261128B1

(12) United States Patent
Rivera

(10) Patent No.: US 7,261,128 B1
(45) Date of Patent: Aug. 28, 2007

(54) WIRE WRAPPING HAND TOOL

(75) Inventor: Thomas Rivera, Bronx, NY (US)

(73) Assignee: JDV Products, Inc., Fair Lawn, NJ (US)

( * ) Notice: Subject to any disclaimer, the term of this patent is extended or adjusted under 35 U.S.C. 154(b) by 223 days.

(21) Appl. No.: 11/174,331

(22) Filed: Jul. 5, 2005

(51) Int. Cl.
*B21F 15/02* (2006.01)
*B21F 3/00* (2006.01)

(52) U.S. Cl. ..... 140/122; 140/124

(58) Field of Classification Search ..... 140/117, 140/122, 123, 124
See application file for complete search history.

(56) References Cited

U.S. PATENT DOCUMENTS 3,219,067 A * 11/1965 Meyer ..... 242/439.3
3,627,054 A * 12/1971 Lay ..... 172/14
3,667,328 A * 6/1972 Stolshek ..... 81/9.4
4,284,109 A * 8/1981 Kilmer et al. ..... 140/122
4,327,781 A * 5/1982 Zach ..... 140/124
4,647,354 A * 3/1987 Walker et al. ..... 204/212
5,613,530 A * 3/1997 Kincel et al. ..... 140/119
6,296,549 B1 * 10/2001 Dickerson et al. ..... 451/28

* cited by examiner

*Primary Examiner*—Derris H. Banks
*Assistant Examiner*—Teresa M. Bonk

(57) ABSTRACT

A hand tool capable of wrapping and unwrapping wires on terminals is provided with a an electrically-insulating drive housing or adaptor and coupling which insulate the bit, and sleeve if present, and driver from the housing and the gear train thereby protecting the user in case of accidental contact between the housing and an active electrical source while the tool is being used. The coupling tightly couples together divided drive shaft portions to maintain the electrical isolation.

11 Claims, 2 Drawing Sheets

WIRE WRAPPING HAND TOOL

This invention relates to a wire wrapping hand tool, and in particular to a tool adapted for hand-operation for wrapping or unwrapping wires around electrical terminals.

BACKGROUND OF THE INVENTION

Wire wrapping tools are well known in the art and are commonly used nowadays for the making of connections to terminals on a printed circuit board (PCB). See, for example, U.S. Pat. Nos. 4,177,555, 4,194,700, and 4,620,574, whose contents are herein incorporated by reference, as examples of such tools. The wrapping tool wraps the wire around a sharp-cornered terminal which crushes any oxide layer between the terminal and wire and provides a tightly-held oxide-free metal-to-metal contact of the wire to the terminal. When the tool is reverse driven, with a different active bit, it can be used to unwrap the wire from the terminal. The typical tool is a wire-wrapping gun containing what is known as a removable bit and sleeve. The latter is typically fixed, and the bit rotates, usually clockwise (CW), within the sleeve. Wire from a spool, for example, is fed through the sleeve to the bit face. The bit has a bore for receiving the terminal, and when the bit is rotated around the terminal, structure on the bit face grabs the wire and wraps it around the terminal. The bit and sleeve are replaceably held on the tool by a front-facing collet or chuck at the distal end of the tool (locations on the tool are with respect to the handle end) which when tightened holds the sleeve within the tool. The bit is held in place within the sleeve by a shoulder on the bit. Replacement of the bit and sleeve is accomplished by loosening of the collet to release the bit and sleeve so it can be removed and replaced. Reasons for replacing include wrapping on a different size of terminal.

So far as we know, all current tools suffer from the problem of possible electrical shocks to the tool user should the terminal be electrically active and the user contacts any metal screws on the tool, or the metal shaft, or the metal trigger gear. Some manufacturers attempt to solve this problem by surrounding a metal tool housing and handle with a plastic electrically-insulated coating, or constructing the tool frame from plastic. However, this is only a partial solution since the trigger gear is still exposed via the bit and sleeve and electrical shock to the user is still possible if the user contacts any part of the metal trigger while the trigger gear contacts an active terminal.

SUMMARY OF THE INVENTION

It is therefore an object of the invention to provide an improved hand tool capable of wrapping or unwrapping wires on terminals and substantially free of the problem of inadvertent electrical shocks to the user.

In accordance with an aspect of the invention, the wrapping/unwrapping tool of the invention incorporates an electrically-insulating drive housing or adaptor and coupling which insulate the bit, and sleeve if present, and driver from the housing and the gear train thereby protecting the user in case of accidental contact between the housing and an active electrical source while the tool is being used.

For simplicity, the description hereafter shall mainly refer to the tool of the invention serving as a wrapping tool, but it will be understood that the same tool with the same advantages can also serve as an unwrapping tool as is well-known in the art. Similarly, the description hereafter shall mainly refer to the tool of the invention as a manual hand tool but it will also be understood that the tool can be power-driven, using batteries or electrical motors.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF THE PREFERRED EMBODIMENT

Figure 1:
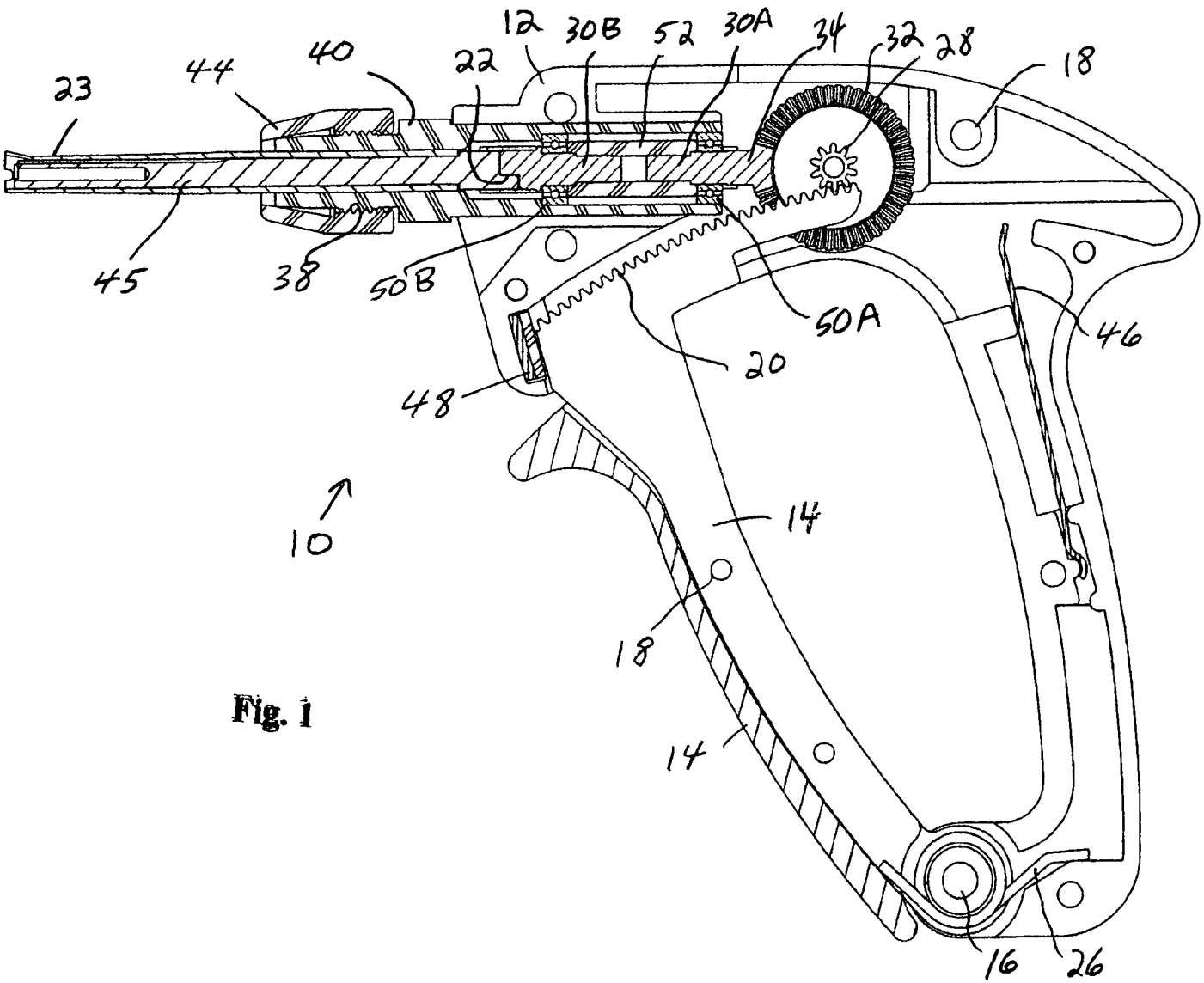
FIG. 1 is a partially sectioned side elevational view of a preferred embodiment of the wire-wrapping tool of the invention.

Reference will now be made in detail to a presently preferred embodiment of the invention, an example of which is illustrated in the accompanying drawings.

A preferred embodiment of the improved wire-wrapping tool, which in this embodiment is a manually-operated wire wrapping tool, is represented generally by numeral 10. As can be seen from the drawings, the manually-operated wire wrapping tool 10 includes a frame 12, and a hand-actuated lever or trigger 14 movably mounted on the frame 12 at a pivot 16. The frame 12 is typically made in two complimentary parts 12A, 12B, held together by metal screws or pins 18. Preferably, the frame is made of aluminum metal and the connecting screws or pins likewise of metal. Alternative methods of making the frame and assembling same are within the scope of the present invention. The frame preferably is coated with a good electrically-insulating coating but this does not eliminate the problem of electrical shocks via contact by the bit and sleeve which are typically also of metal with an active terminal.

The hand actuated lever 14, having a gear rack 20 formed at one end, is adapted for comfortable squeezing by hand. Spring members 26 are mounted about the pivot 16 such that force from the springs biases the lever 14 in a direction outwardly from the frame 12.

When squeezed, the lever 14 pivots on the pivot 16 towards the rear of the frame 12, and the spring members 26 are thereby further tensioned. The squeezing movement provides power for the wire-wrapping tool 10 as will be further described below. The gear rack 20 is formed or mounted near the end of the lever 14 opposite the pivot 16 and includes a plurality of teeth (some not shown) which intermesh with the teeth of a spur gear 28 which is part of a rotatable drive assembly 30. The specific construction of the drive assembly 30 which incorporate aspects of the present invention will be described in greater detail below. Generally, these assemblies comprise a spur gear, a driven gear and various translational gears that are designed to impart rotary motion to an output shaft or bit. In the presently preferred embodiment, the rotatable drive assembly comprises a spur gear 28 integrally formed and coaxial with a driven gear 32, a pinion gear 34, and a bearing 36.

In the known constructions, the pinion gear 34 is integral with a drive shaft all supported by a metal drive housing 40.

More on this later. The gear rack 20 drives the spur gear 28 and the driven gear 32 in a counter-clockwise direction (FIG. 1) thereby driving the pinion gear which drivingly engages the drive shaft, such as by means of a key. The drive shaft is rotatably mounted in the drive housing 40 which is held fixedly in place in the frame 12 by any suitable means. An adjustable collet nut 44 is adapted to engage a threaded end 38 of the drive housing 40 to secure a terminal wire connecting bit/sleeve assembly 45 when inserted into the drive housing 40 to engage the drive shaft.

Mounting of the gearing and drive assembly within the frame can be by conventional means except for the changes that will be described in detail below as part of the invention.

In operation, which is the same for the known tools, when the lever 14 is squeezed toward the rear of the frame 12, the gear rack 20 drives the spur gear 28 and driven gear 32 and the rotatable drive assembly. A backstop 46, comprised of a tensioned bar or leaf spring positioned within the frame 12, is contacted by the gear rack 20 as it is squeezed toward frame 12. The backstop 46 aids in avoiding impact of the gear rack 20 against the frame 12. The backstop 46 exerts force against the gear rack 20 and is mounted to permit travel a short distance with increasing resistance against the gear rack 20, thus encouraging the gear rack 20 to slow down as it approaches the frame 12. When pressure on the lever 14 is released, the spring members 26 cause the lever 14 to return to its normal rest position. The lever 14 comes to rest when the gear rack 20 abuts against a gear rack stop 48 mounted in the frame 12. Preferably, a shock absorbing piece of resilient material, such as rubber, can be included on one side of the stop 48 to help absorb impact or to act as a spacer.

As indicated above, an electric motor, activated by batteries or line voltage can be substituted to drive the bit via a known gear system. The bit end, which has a flat 22, sits in and rotates within the outer sleeve 23.

As indicated earlier, to avoid the electrical shock problem, in accordance with an aspect of the invention, the drive shaft is physically spit into two axially-aligned portions 30A, 30B. The proximal part 30A is integral with the pinion 34 and will be hereafter from time to time referred to as the first shaft portion or pinion shaft. The distal part 30 B likewise has a flat to engage and couple to the flat 22 on the bit and thus drives the latter, and will be hereafter from time to time referred to as the second shaft portion or drive shaft. Each shaft portion 30A, 30B is supported by a bearing 50A, respectively 50B, journaled for rotation within the drive housing 40. Both shaft parts 30A, 30B are tightly coupled together by a surrounding coupling 52. The latter is secured at its right proximate end (FIG. 1) to and rotates with the pinion shaft 30A and at its left distal end (FIG. 1) to and rotates with the drive shaft 30B. The connection can be by way of key or pin, but it is preferred to use a press-fit connection, which it is surprisingly found to be sufficiently strong to withstand any normal pulling or twisting forces during use. Preferably, this is obtained by knurling a portion of the drive shaft (indicated by the thicker line 25 in FIG. 2) and forcing it into the complementary bore of the hollow coupling 52. The pinion shaft fits on the other end and uses the same knurl and press fit arrangement. The coupling 52 is constituted of an electrically-insulated plastic such as ABS and thus the two shaft portions 30A, 30B are electrically-insulated from one another.

As a further feature of the invention, the drive housing 40 is also constituted of an electrically-insulated plastic such as ABS and thus the entire frame metal parts are electrically-insulated from the bearing 50B, the bit/sleeve combination 45, the split drive shafts 30A, 30B, and the gear train 20, 28, 32, 34. This combination of the electrically-insulated split shaft coupling 52 and the drive housing 40 accomplishes the goal of ensuring that no inadvertent contacting of the bit/sleeve to an electrically active terminal will cause an electrical shock to the tool operator. As additional protection, the collet nut 44 is also made out of plastic and this helps to avoid electrical shorts between terminals.

Figure 2:
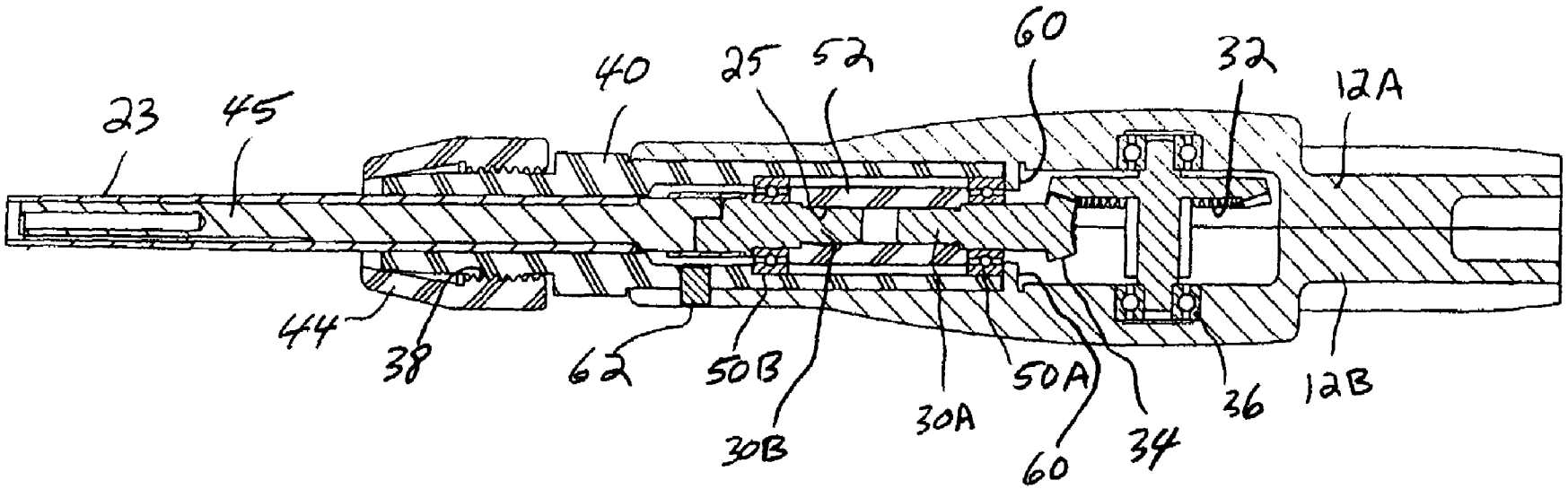
FIG. 2 is a sectional view from the top of the wire-wrapping tool of FIG. 1.

As still a further feature of the invention, the assembled rotating components within the drive housing 40 are retained within the frame by frame tabs 60 (FIG. 2) and pins 62, one of which is shown in FIG. 2. During the assembly process, after the pin 62 has been fixed to the drive housing 40, the gears are disengaged and the pinion shaft 30A and drive shaft 30B are together rotated until the bit-engaging flat on the distal drive shaft 30 B has acquired a preset (rotary) orientation. This preset orientation ensures that when the rotating components within the drive housing 40 stop rotating during use of the gun, the preset flat orientation will always have the same orientation to receive and couple to the flat 22 on the bit. Then, the assembly is completed and the gears reengaged. The tabs 60 at the proximal end keep the bearing 50A from moving out of the drive housing 40 and maintain the gears assembly in its final engaged relationship, once set. This feature reduces assembly time and also makes disassembly very easy when required.

The plastic material of the drive housing 40 is tough enough so that screw threads 38 provided at its distal end will resist damage due to frequent tightening and loosening of the sleeve-holding collet 44. The latter, preferably electrically-insulated, can also be electrically-conductive if desired, with only a small loss in protection as it does not affect the electrically-insulating effect of the electrically-insulated drive housing 40 and shaft coupling 52.

Conventional wrapping bits and sleeve or unwrapping bit can be used with the tool of the invention.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A hand-held wire-wrapping or unwrapping gun, comprising:

a) a frame having user-accessible electrically-conductive elements, b) a rotatable drive assembly journaled on said frame and including an electrically-conductive drive shaft coupled at a distal end to means for receiving and removably holding an electrically-conductive bit for wrapping or unwrapping a wire around an electrical terminal, c) user-actuating means for driving the drive shaft and bit, d) means for electrically-insulating the frame from the electrically-conductive drive shaft and the electrically-conductive bit, the means for electrically-insulating the frame comprising an electrically-insulated drive housing surrounding the drive shaft and bit and separating the latter from the frame's electrically-conductive elements, the means for electrically-insulating the frame further comprising divided drive shaft portions and electrically-insulated means for coupling together the divided drive shaft portions, such that electrical shock to the user is avoided upon accidental contact between the user and one of the electrically-conductive elements of the frame when the tool bit during use contacts an electrically active electrical terminal.

2. A hand-held wire-wrapping or unwrapping gun as claimed in claim 1, further comprising an electrically-insulating outer coating on the frame.

3. A hand-held wire-wrapping or unwrapping gun as claimed in claim 1, wherein the electrically-insulated drive housing is part of the electrically-conductive bit holding means.

4. A hand-held wire-wrapping or unwrapping gun as claimed in claim 1, wherein the electrically-insulated drive housing comprises at an end remote from the user-actuating means a chuck or clamp for removably gripping and releasing the bit.

5. A hand-held wire-wrapping or unwrapping gun as claimed in claim 4, wherein the chuck or clamp comprises a rotatable collet constituted of electrically-insulated material.

6. A hand-held wire-wrapping gun, comprising:

a) an electrically-conductive frame having an electrically-insulating outer coating and also user-accessible exposed electrically-conductive elements, b) a rotatable drive assembly journaled on said frame and including a electrically-conductive first shaft coupled to user-actuating means for driving the first shaft and at the distal end of the gun an axially-spaced electrically-conductive second drive shaft coupled to holding means for receiving and removably holding an electrically-conductive bit or bit-and-sleeve assembly for unwrapping or wrapping a wire around an electrical terminal when the bit is rotated, c) electrically-insulated coupling means for connecting the first shaft to the second shaft such that rotation of the first shaft causes rotation of the second shaft, d) the bit-and-sleeve holding means comprising a user-operated chuck or clamp for removably gripping and releasing the bit-and-sleeve assembly, the bit-and-sleeve holding means further comprising an electrically-insulating portion serving as a drive housing and surrounding the coupling means and second shaft and electrically-insulating the frame from the first and second shafts and adjacent bit or bit-and-sleeve, such that electrical shock to the user is avoided upon accidental contact between the user and one of the electrically-conductive elements of the frame when the tool bit during use contacts an active electrical terminal.

7. A hand-held wire-wrapping gun as claimed in claim 6, wherein the coupling and electrically-insulating portion of the bit-and-sleeve holding means comprises a plastic material.

8. A hand-held wire-wrapping gun as claimed in claim 6, wherein the coupling means is press-fitted to end portions of the first and second shafts.

9. A hand-held wire-wrapping gun as claimed in claim 6, wherein the frame comprises tabs for retaining the rotating components within the electrically-insulating drive housing.

10. A hand-held wire-wrapping gun as claimed in claim 9, further comprising a pin for retaining the electrically-insulating drive housing and maintaining the orientation of the second shaft.

11. A hand-held wire-wrapping gun as claimed in claim 6, further comprising user-actuating means for rotating the drive assembly, the drive assembly comprising a spur gear driving a pinion gear, the pinion gear being integral with the first shaft portion.

* * * * *